US010183776B2

(12) United States Patent
Westney et al.

(10) Patent No.: US 10,183,776 B2
(45) Date of Patent: Jan. 22, 2019

(54) REINFORCED CARTON

(71) Applicant: Georgia-Pacific Corrugated LLC, Atlanta, GA (US)

(72) Inventors: John Leigh Westney, Mableton, GA (US); Ernest B. Widner, Gainesville, GA (US); Theodore Andrew Samotis, Erlanger, KY (US); Yavuz Aksan, Suwanee, GA (US)

(73) Assignee: GEORGIA-PACIFIC CORRUGATED LLC, Atlanta, GA (US)

( * ) Notice: Subject to any disclaimer, the term of this patent is extended or adjusted under 35 U.S.C. 154(b) by 422 days.

(21) Appl. No.: 14/239,092

(22) PCT Filed: Jan. 8, 2014

(86) PCT No.: PCT/US2014/010587
§ 371 (c)(1),
(2) Date: Feb. 14, 2014

(87) PCT Pub. No.: WO2014/110070
PCT Pub. Date: Jul. 17, 2014

(65) Prior Publication Data

US 2016/0068298 A1 Mar. 10, 2016

Related U.S. Application Data

(60) Provisional application No. 61/750,428, filed on Jan. 9, 2013.

(51) Int. Cl.
*B65D 5/44* (2006.01)
*B65D 5/42* (2006.01)

(52) U.S. Cl.
CPC ..... *B65D 5/443* (2013.01); *B65D 5/4266* (2013.01)

(58) Field of Classification Search
CPC ..... B65D 5/443; B65D 5/4266; B65D 5/4295
See application file for complete search history.

(56) References Cited

U.S. PATENT DOCUMENTS

| | | | | |
|---|---|---|---|---|
| 272,327 A | | 2/1883 | Rogers | |
| 981,993 A | | 1/1911 | Gair et al. | |
| 1,892,594 A | | 12/1932 | Stone | |
| 1,971,863 A | * | 8/1934 | Lupton | B65D 5/326 206/176 |

(Continued)

FOREIGN PATENT DOCUMENTS

| | | |
|---|---|---|
| CL | 199400362 A | 5/1995 |
| CL | 199501348 A | 6/1996 |

(Continued)

OTHER PUBLICATIONS

PCT Search Report and Written Opinion for PCT/US2014/010587 dated May 14, 2014.

(Continued)

*Primary Examiner* — Corey N Skurdal

(57) ABSTRACT

The present application provides a reinforced carton. The reinforced carton may include a number of first panels, a number of adjoining second panels, and with the first panels including one or more strength enhancing features. The one or more strength enhancing features may include a vertical fold line extending across the first panels.

22 Claims, 2 Drawing Sheets

(56) References Cited

U.S. PATENT DOCUMENTS 2,082,365 A 6/1937 Straw et al.
2,114,052 A 4/1938 Kincade
2,300,492 A 11/1942 Fischer
2,346,488 A 4/1944 Hoffmaster et al.
2,367,717 A 1/1945 Davidson
2,547,892 A 4/1951 Stevens
2,631,772 A * 3/1953 Hiersteiner ..... B65D 5/3607 229/117.06
2,811,296 A 10/1957 Long
2,839,236 A 6/1958 Dunning
2,857,090 A 10/1958 Fallert
2,887,389 A 5/1959 Linville
2,962,202 A 11/1960 Hansen
3,017,064 A 1/1962 Davis
3,100,072 A 8/1963 Mason
3,163,344 A 12/1964 Tunick
3,164,316 A 1/1965 Wurster et al.
3,202,339 A 8/1965 Franklin
3,206,099 A 9/1965 Fanter et al.
3,217,924 A 11/1965 Chidsey
3,251,533 A * 5/1966 Cohen ..... B65D 5/326 229/117.05
3,265,285 A 8/1966 Fanter
3,309,005 A 3/1967 Pilger
3,353,740 A 11/1967 Outwater
3,375,967 A 4/1968 Robinson
3,447,735 A 6/1969 Whitney
3,481,527 A 12/1969 Jacke
3,552,633 A 1/1971 Ketler
3,565,325 A * 2/1971 Pugsley ..... B65D 5/3628 229/117.05
3,642,192 A * 2/1972 Wilcox, Jr. ..... B65D 5/061 229/117.05
3,688,972 A 9/1972 Mahon
3,698,548 A 10/1972 Stenzel et al.
3,744,705 A 7/1973 Kuhn et al.
3,747,801 A 7/1973 Graser
3,826,421 A 7/1974 Morse et al.
3,883,067 A 5/1975 McGlynn et al.
3,899,123 A 8/1975 Stollberg
3,963,170 A 6/1976 Wood
4,029,207 A 6/1977 Gordon
4,042,166 A 8/1977 Selin et al.
4,056,223 A 11/1977 Williams
4,081,124 A * 3/1978 Hall ..... B65D 5/22 206/386
4,084,693 A 4/1978 Culpepper
4,093,116 A 6/1978 Watkins et al.
4,094,458 A * 6/1978 Nelson, Jr. ..... B65D 5/3628 229/117
4,256,226 A 3/1981 Stone
4,267,959 A 5/1981 Gilbert
4,283,001 A 8/1981 Meyers
4,548,323 A 10/1985 Rekow
4,549,688 A * 10/1985 Ozmon ..... B65D 5/3685 229/117.06
4,572,423 A 2/1986 Spencer
4,702,407 A 10/1987 Lisiecki
4,771,939 A 9/1988 Wilkins
4,850,527 A 7/1989 Church et al.
4,948,033 A 8/1990 Halsell, II et al.
5,002,224 A 3/1991 Muise
5,085,367 A 2/1992 Carstens
5,090,614 A * 2/1992 Kupersmit ..... B65D 5/36 229/117.04
5,117,973 A 6/1992 Lo Duca
D337,270 S 7/1993 Brockman
5,323,957 A 6/1994 Roosa
5,335,844 A 8/1994 Young
5,392,985 A 2/1995 Smith et al.
5,400,955 A 3/1995 Coalier et al.
5,427,242 A 6/1995 Oliff et al.
5,450,998 A * 9/1995 Esse ..... B65D 5/606 229/117.27
5,474,232 A 12/1995 Ljunstrom et al.
5,535,941 A 7/1996 Garza
5,662,508 A 9/1997 Smith
5,671,883 A 9/1997 Philips
5,690,601 A 11/1997 Cummings et al.
5,755,377 A 5/1998 Durand
5,772,110 A 6/1998 Garretson
5,839,650 A 11/1998 Sheffer
5,918,801 A 7/1999 Milio
5,921,398 A * 7/1999 Carroll ..... B65D 5/5253 206/736
5,950,912 A 9/1999 Economopoulos
5,957,294 A 9/1999 Kanter
6,098,874 A 8/2000 Tokarski
6,132,349 A 10/2000 Yokoyama
6,247,593 B1 6/2001 Ruble et al.
6,640,975 B2 11/2003 Bennett et al.
6,660,368 B2 12/2003 Cooley et al.
6,834,793 B2 12/2004 Sutherland
6,866,186 B2 3/2005 Fogle et al.
6,935,504 B2 8/2005 Ritter et al.
7,124,890 B2 10/2006 Mcleod et al.
7,201,714 B2 4/2007 Zoeckler et al.
7,261,231 B2 8/2007 Kuhn et al.
7,628,311 B2 12/2009 Kuhn et al.
7,673,787 B2 3/2010 Mittelstaedt et al.
7,766,219 B2 8/2010 Gomes et al.
7,832,623 B1 11/2010 Capogrosso
8,251,276 B2 8/2012 McLeod
8,579,778 B2 11/2013 Aganovic et al.
8,690,047 B2 4/2014 McKenna et al.
8,727,204 B2 * 5/2014 Burke ..... B65D 5/2028 229/101
8,851,362 B2 * 10/2014 Aksan ..... B65D 5/0227 229/120
2002/0008134 A1 1/2002 Southwell
2003/0234285 A1 12/2003 Bates et al.
2005/0189405 A1 9/2005 Gomes
2005/0236466 A1 10/2005 Mcleod
2005/0279815 A1 12/2005 Fogle et al.
2006/0196920 A1 9/2006 Moen et al.
2007/0000986 A1 1/2007 McClure
2007/0063005 A1 3/2007 Gomes et al.
2007/0138244 A1 6/2007 England
2007/0152027 A1 7/2007 Hyatt et al.
2008/0041926 A1 * 2/2008 Goodrich ..... B65D 5/324 229/199
2009/0095799 A1 4/2009 Garner
2009/0121003 A1 5/2009 Gasior
2009/0121006 A1 5/2009 Garner
2009/0286663 A1 11/2009 Little et al.
2010/0078466 A1 * 4/2010 Stack, Jr. ..... B65D 81/075 229/120.38
2010/0219232 A1 9/2010 Smith
2010/0264049 A1 10/2010 Maillot
2011/0204127 A1 8/2011 Brundage et al.
2011/0204131 A1 8/2011 Brundage et al.
2011/0244259 A1 * 10/2011 Van Berlo ..... B31D 3/007 428/514
2011/0281705 A1 11/2011 Aganovoc
2012/0000973 A1 1/2012 McLeod
2012/0055922 A1 3/2012 Askan et al.
2012/0061456 A1 3/2012 Rosas et al.
2013/0048704 A1 * 2/2013 Lewis ..... B65D 5/0015 229/190
2013/0126594 A1 5/2013 Gasior et al.
2014/0174977 A1 6/2014 McKenna et al.

FOREIGN PATENT DOCUMENTS

CL 199501794 A 9/1996
CL 200001067 A 6/2001
DE 1281342 B 10/1968
DE 3222017 A1 12/1983
EP 0468860 A1 1/1992
FR 1284481 A 2/1962
GB 2270678 A 3/1994
GB 2419345 A 4/2006

(56) References Cited

FOREIGN PATENT DOCUMENTS

| | | | | | |
|---|---|---|---|---|---|
| GB | 2436830 | A | | 10/2007 | |
| KR | 20-20080006523 | U | | 12/1998 | |
| KR | 19980067913 | U | | 12/1998 | |
| KR | 10-20100052013 | A | | 5/2010 | |
| NL | 9301699 | A | * | 5/1995 | ..... B65D 5/443 |
| NL | 9301699 | A | | 5/1995 | |
| WO | 93/03967 | | | 3/1993 | |
| WO | 0068098 | | | 11/2000 | |
| WO | 2001/66423 | A1 | | 9/2001 | |
| WO | 2006/026767 | A2 | | 3/2006 | |
| WO | 2006095097 | A2 | | 9/2006 | |
| WO | 2010128874 | A1 | | 11/2010 | |

OTHER PUBLICATIONS

International Search Report and Written Opinion of the International Searching Authority for PCT/US2011/050347 dated Mar. 19, 2012.

European Patent Office, European Patent Office, Extended European Search Report for 11822726.3, dated Jun. 2, 2015, six pages, Munich, Germany.

* cited by examiner

REINFORCED CARTON

TECHNICAL FIELD

The present application and the resulting patent relate generally to a box or a carton and more particularly relate to a corrugated paperboard carton with one or more strength enhancing features such as vertical fold lines for improved overall compression strength.

BACKGROUND OF THE INVENTION

Corrugated boxes and cartons are in wide use to pack, ship, store, and/or display many different types of products. Specifically, these boxes and cartons should securely retain and protect the products therein during shipping and storage while providing easy access to the products for later display and/or removal. Moreover, existing supply chain requirements also should be met so as to ensure efficient production, transport, and use of the box or carton across one or more industries or across one or more geographies.

One popular style of a box or a carton is known as a regular slotted carton. Regular slotted cartons and the like are in common use for packaging and shipping any number of different types of products. Generally described, a regular slotted carton has four rectangular sidewall panels. The top and bottom ends are usually formed from pairs of sidewall panel flaps. These sidewall panel flaps generally meet in the middle with no overlap. Such a regular slotted carton is usually made from a single rectangular blank with little material waste for cost effective and efficient manufacture. Regular slotted cartons typically may be used for products that require relatively high top to bottom stacking strength such as for plastic bottles and the like. Although known regular slotted cartons typically have considerable stacking strength, further strength improvements would be helpful and would provide additional versatility in use.

There is thus a desire for an improved carton design. Preferably such a carton design may provide the versatility of known carton designs, such as a regular slotted carton, with reinforced strength for superior stacking and shipping with the use of a reduced amount of corrugated material.

SUMMARY OF THE INVENTION

The present application and the resultant patent provide a reinforced carton. The reinforced carton may include a number of first panels, a number of adjoining second panels, and with the first panels including one or more strength enhancing features. The one or more strength enhancing features may include a vertical fold line extending across the first panels.

The present application and the resultant patent further provide a reinforced corrugated carton. The reinforced corrugated carton may include a pair of first panels, a pair of adjoining second panels, and with the pair of first panels including one or more strength enhancing features. The one or more strength enhancing features may include a combination of scores and perforations extending vertically across the pair of first panels.

The present application and the resultant patent further may provide a reinforced corrugated carton. The reinforced corrugated carton may include a pair of first panels, a pair of adjoining second panels, and with the pair of first panels including a number of strength enhancing features. The strength enhancing features may include a combination of scores and perforations extending vertically across the pair of first panels and a number of slots positioned about the pair of first panels and/or the pair of adjoining second panels.

These and other features and improvements of the present application and the resultant patent will become apparent to one of ordinary skill in the art upon review of the following detailed description when taken in conjunction with the several drawings and the appended claims.

DETAILED DESCRIPTION

Figure 1:
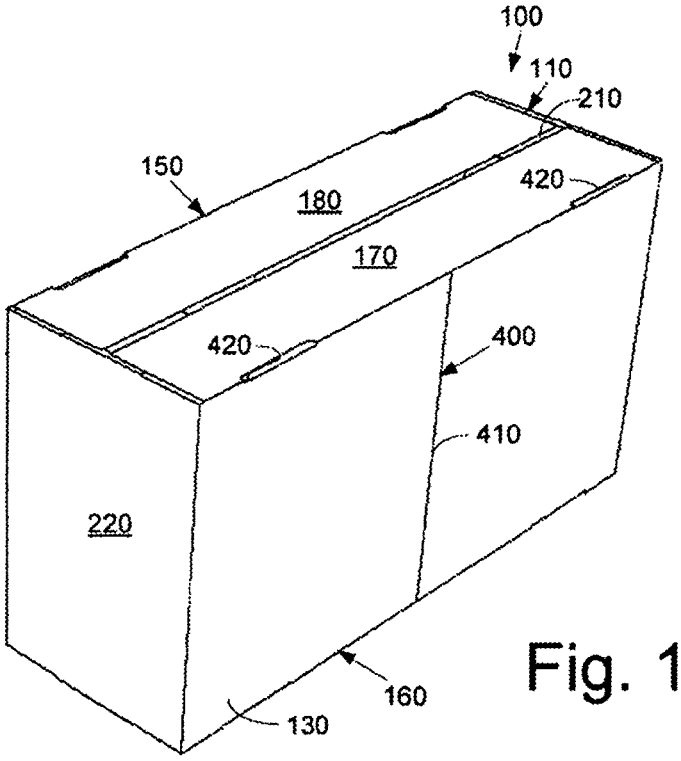
FIG. 1 is a perspective view of an example of a carton as may be described herein.
Figure 2:
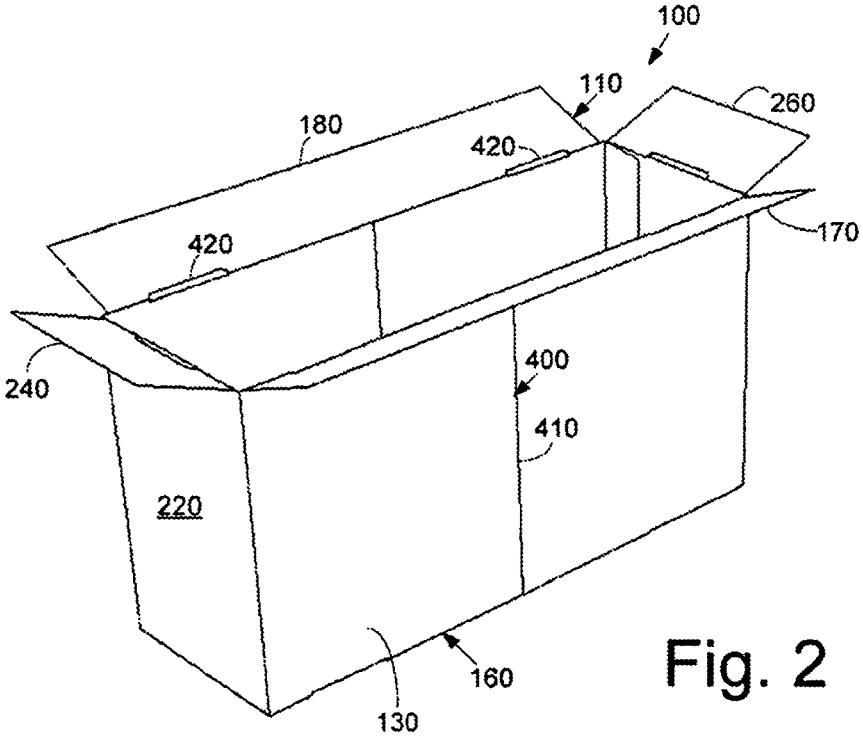
FIG. 2 is further perspective view of the carton of FIG. 1 shown in an open configuration.

Referring now to the drawings, in which like numerals refer to like elements throughout the several views, FIGS. 1 and 2 show an example of a carton 100 as may be described herein. In this example, the carton 100 may be a regular slotted carton 110 as will be described in more detail below. Other types of cartons 100 may be used herein. The carton 100 may contain any number or any type of products therein. In describing the carton 100, the terms "bottom," "top," "side," "end," and the like are used for purposes of relative orientation only and not as absolute positions. For example, any surface of the carton 100 may be used as the bottom or the top as oriented by a user. Further, the terms "length," "width," "height," and the like refer to relative orientations. Similarly, the term "carton" is meant to encompass "boxes," "containers," and any other type of enclosure as well as partial or non-continuous enclosures.

The carton 100 may be made out of a corrugated paperboard stock 120 and the like. The corrugated paperboard stock 120 may be recyclable. The corrugated paperboard stock 120 may have a single wall construction and may be coated or uncoated. In this example, the coated paperboard stock 120 may be a "B-Flute" type corrugated board with about forty-seven (47) flutes per linear foot and a vertical orientation. Other types of corrugated paperboard stock 120 such as double wall constructions and the like also may be used. Other suitable types of substrates also may be used herein. The carton 100 may have any suitable overall size. The size of the carton 100 may be standard according to the intended industry, intended geography, or other type of use parameter. Any suitable type of graphics, messaging, and other types of indicia may be printed or otherwise applied to the carton 100.

The carton 100 may have a first sidewall panel 130 and opposed second sidewall panel 140. The carton 100 also may include a top wall 150 and an opposed bottom wall 160. The top wall 150 may be formed from a first sidewall panel top flap 170 extending from the first sidewall panel 130 and a second sidewall panel top flap 180 extending from the second sidewall panel 140. The bottom wall 160 may be formed from a first sidewall panel bottom flap 190 extending from the first sidewall panel 130 and a second sidewall panel bottom flap 200 extending from the second sidewall panel 140. The top flaps 170, 180 and/or the bottom flaps 190, 200 may or may not be in contact with each other. For example, a gap 210 may extend between the flaps 170, 180 and/or the flaps 190, 200 when in a closed orientation as is shown in FIG. 1. The gap 210 may assist in opening the carton 100. Other sizes, shapes, and configurations may be used herein.

The carton 100 may include a first end wall panel 220 and an opposed second end wall panel 230. The end wall panels 220, 230 may be positioned between the first sidewall panel 130, the second sidewall panel 140, the top wall 150, and the bottom wall 160 so as to form the substantially rectangular carton 100. Other types of suitable shapes may be used herein. The first end wall panel 220 may have a first end wall panel top flap 240 and a first end wall panel bottom flap 250. The second end wall panel 230 may have a second end wall panel top flap 260 and a second end wall panel bottom flap 270. The end wall panel top flaps 240, 260 may be positioned within the sidewall panel top flaps 170, 180 and attached thereto to form the top wall 150. The end wall panel bottom flaps 250, 270 may be positioned within the sidewall panel bottom flaps 190, 200 and attached thereto to form the bottom wall 160. Although the end wall panels 220, 230 are shown as being of lesser length than the sidewall panels 130, 140, the end wall panels 220, 230 may be of equal or greater length. Other sizes, shapes, and configurations may be used herein.

Figure 3:
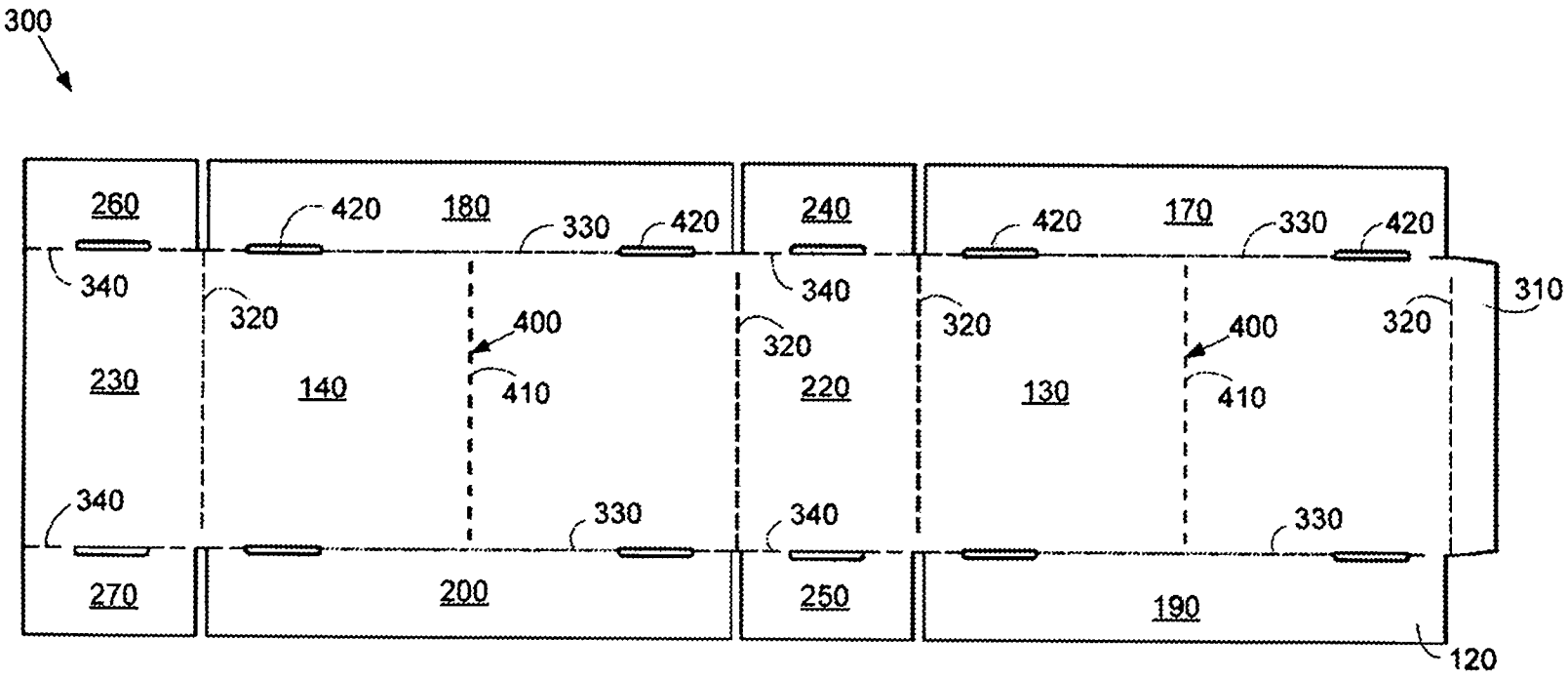
FIG. 3 is a plan view of a blank that may be used to construct the carton of FIG. 1.

FIG. 3 shows a blank 300 that may be used to erect the carton 100. The blank 300 may have any suitable size or shape. As described above, the blank 300 may be a single piece of the corrugated paperboard material 120. In addition to the panels and flaps described above, the blank 300 also may include one or more glue panels 310. The glue panel 310 may be attached to the first sidewall panel 130 or the second end wall panel 23 as is shown. The glue panel 310 may be attached elsewhere depending upon the configuration of the blank 300. The blank 300 also may include the sidewall panels 130, 140, the sidewall panel top flaps 170, 180, and the sidewall panel bottom flaps 190, 200. The blank 300 also may include the end wall panels 220, 230, the end wall panel top flaps 240, 260, and the end wall panel bottom flaps 250, 270. The sidewall panels 130, 140 may be separated from the end panels 220, 230 and the glue panel 310 by a number of corner fold lines 320. The side wall panel flaps 170, 180, 190, 200 may be separated from the sidewall panels 130, 140 by a number of sidewall panel flap fold lines 330. The end wall panel flaps 240, 250, 260, 270 may be separated from the end wall panels 220, 230 by a number of end wall panel flap fold lines 340. Other types of suitable configurations also may be used herein.

It will be understood that the fold lines may be formed by crushing or scoring the corrugated paperboard stock 120 along the line to be folded so as to facilitate bending and forming of the various panels and flaps herein. Unless otherwise noted, the term "fold line' may be used interchangeably with the terms "tear lines", "score lines", "perforated lines", and the like. Other suitable types of construction techniques also may be used herein. The blank 300 may be of any suitable size. The various flaps described herein and the like may be attached to one another by a conventional adhesive as well as by stapling and other suitable types of attachment methods.

To assemble the blank 300 into the carton 100, the sidewall panels 130, 140 and the end wall panels 220, 230 may be folded about the corner fold lines 320. The glue panel 310 may be folded and glued or otherwise attached to the second end wall panel 230. The end wall panel flaps 240, 250, 260, 270 may be folded along the end wall panel flap fold lines 340. The side wall panel flaps 170, 180, 190, 200 may be folded along the sidewall panel flap fold lines 330 and glued or otherwise attached to the end wall panel flaps 240, 250, 260, 270. The carton 100 is now secure and ready for shipment or other use. Other and additional method steps may be used herein in any order.

The carton 100 also may include a number of strength enhancing features 400. For example, the carton 100 may have a number of vertical fold lines 410 extending along the vertical length of the sidewall panels 130, 140. (By the term "vertical fold line" we mean substantially parallel to the flute orientation.) The vertical fold lines 410 may be positioned about the middle of the sidewall panels 130, 140 or elsewhere. Although one vertical fold line 410 is shown on each of the sidewall panels 130, 140, multiple vertical fold lines 410 may be used. One or more vertical fold lines 410 also may be positioned about the end wall panels 220, 230 or elsewhere.

The vertical fold lines 410 also may take the form of a score line, a line of perforations, and/or a line of scores and perforations. Different types of vertical fold lines, score lines, lines of perforations, lines of combinations of scores and perforations, and the like may be used herein. Each of these different lines may result in differing strength enhancements. The vertical fold lines 410 may be continuous or intermittent. Different types of vertical fold lines 410 may be used on the same carton 100. Other shapes, sizes, and configurations may be used herein.

The vertical fold lines 410 may aid in overall top to bottom compression strength. Specifically, the vertical fold lines 410 may strengthen the sidewall panels 130, 140 by subdividing the panels so as to reduce panel buckling while under load. The vertical fold lines 410 may increase the compression strength of the carton 100 by making the sidewall panels 130, 140 (or other panels) more resistant to deformation or buckling. Specifically, the vertical fold lines 410 may provide for controlled buckling/deformation in a specified direction. The vertical fold lines 410 may allow the sidewall panels 130, 140 to bend in an opposite direction to the natural direction that the panels 130, 140 tend to bulge during top to bottom compression. The type, number, and configuration of the vertical fold lines 410 may vary with the size, shape, and configuration of the carton 100 and based upon other types of parameters. Other components and other configurations also may be used herein.

Previous cartons may have used either non-vertical fold lines and/or incomplete fold lines so as promote failure or bulging in a predetermined manner, so as to prevent pallet overhang and the like. The vertical fold lines 410 described herein increase overall top to bottom compression strength so as to prevent or limit failure or bulging.

The improvement in compression strength may be shown via the use of a conventional box compression tester. The box compression tester generally includes a pair of parallel platens. The box compression tester may exert a dynamic load on the cartons placed therebetween and may track force versus deflection and the like. Other methods of applying a load and measuring compression strength and the like also may be used herein. Repeated testing of the cartons 100 with the vertical fold lines 410 described herein showed an increase in compression strength of about twenty percent (20%) or more as compared to cartons without such strength enhancing features. Specifically, a carton 100 made with a B-flute paperboard stock 120 (E32B 33MW-U37B-U60 with a total basis weight of 97 lbs/msf) was used in this example. Of interest is that the compression strength increased as the vertical fold lines 401 approached the center of the sidewall panel 130, 140. Moreover, overall compression strength was improved without the use of additional material and the associated costs.

The carton 100 also may have other types of strength enhancing features 400. For example, the carton 100 may have a number of the slots 420 formed between the sidewall panels 130, 140 and the sidewall flaps 170, 180, 190, 200 and between the end wall panels 220, 230 and the end wall flaps 240, 250, 260, 270. The number of the slots 420, the offset of the slots 420 (if any), the spacing of the slots 420, and the length of the slots 420 may depend on the overall size of the carton 100 and other parameters. The slots 420 also may assist in load bearing by laterally distributing the load therein. Other suitable sizes, shapes, and configurations also may be used herein.

Although the strength enhancing features 400 have been described herein in the context of a regular slotted carton 110, the strength enhancing features 400 may be applicable to almost any type of carton and the like so as to provide improved compression strength and stackability. Other types of strength enhancing features 400, and combinations thereof, may be used herein.

It should be apparent that the foregoing relates only to certain embodiments of the present application and the resultant patent. Numerous changes and modifications may be made herein by one of ordinary skill in the art without departing from the general spirit and scope of the invention as defined by the following claims and the equivalents thereof.

We claim:

1. A reinforced carton, comprising:

a plurality of first panels comprising a first sidewall panel and a second sidewall panel;

a plurality of second panels that adjoin the plurality of first panels, the plurality of second panels comprising a first end wall panel and a second end wall panel;

wherein the first and second end wall panels have a lesser length than the first and second sidewall panels;

the plurality of first panels and the plurality of adjoining second panels forming an enclosure comprising the first sidewall panel, the second sidewall panel, the first end wall panel, the second end wall panel, and further comprising a top wall, and a bottom wall, wherein the first sidewall panel, the second sidewall panel, the first end wall panel, and the second end wall panel each have vertically oriented flutes; and the plurality of first panels comprising one or more strength enhancing features;

wherein the one or more strength enhancing features comprise a vertical line of intermittent perforations absent a coexisting fold line extending between a bottom and a top of and disposed at a center of the first sidewall panel, the vertical line of intermittent perforations oriented parallel with the vertically oriented flutes;

wherein the vertical line of intermittent perforations subdivides the first sidewall panel without the vertical line of intermittent perforations extending beyond planar outer and planar inner surfaces of the first sidewall panel.

2. The reinforced carton of claim 1, wherein the vertical line of intermittent perforations absent a coexisting fold line further comprises a score line.

3. The reinforced carton of claim 1, wherein the vertical line comprises a combination of scores and the intermittent perforations.

4. The reinforced carton of claim 1, further comprising a plurality of vertical lines of intermittent perforations absent coexisting fold lines extending between the bottom and the top of the first sidewall panel.

5. The reinforced carton of claim 1, wherein the one or more strength enhancing features further comprises a second vertical line of intermittent perforations absent a coexisting fold line extending between a bottom and a top of the second sidewall panel, wherein the second vertical line of intermittent perforations subdivides the second sidewall panel without the second vertical line of intermittent perforations extending beyond planar outer and planar inner surfaces of the second sidewall panel.

6. The reinforced carton of claim 1, wherein the one or more strength enhancing features further comprises a plurality of slots positioned about the plurality of first panels and/or the plurality of adjoining second panels.

7. The reinforced carton of claim 1, wherein the top wall comprises a gap.

8. The reinforced carton of claim 7, wherein the top wall comprises a first sidewall panel top flap and a second sidewall panel top flap.

9. The reinforced carton of claim 7, wherein the top wall comprises a first end wall panel top flap and a second end wall panel top flap.

10. The reinforced carton of claim 1, wherein the reinforced carton comprises a regular slotted carton.

11. The reinforced carton of claim 1, wherein the enclosure is formed of a single piece of corrugated material.

12. A reinforced corrugated carton, comprising:

a plurality of panels comprising a pair of first panels and a pair of adjoining second panels;

wherein the pair of second panels have a lesser length than the pair of first panels;

the plurality of panels forming an enclosure comprising the pair of first panels and the pair of adjoining second panels, and further comprising a top wall, and a bottom wall, wherein the pair of first panels and the pair of adjoining second panels each have vertically oriented flutes; and the pair of first panels comprising one or more strength enhancing features;

wherein the one or more strength enhancing features comprise a linear combination of intermittent scores and perforations absent a coexisting fold line extending vertically between a bottom and a top of and disposed at a center of each panel of the pair of first panels parallel with the vertically oriented flutes;

wherein each linear combination of intermittent scores and perforations respectively subdivide each panel of the pair of first panels without each respective linear combination of intermittent scores and perforations extending beyond planar outer and planar inner surfaces of each panel of the pair of first panels.

13. The reinforced corrugated carton of claim 12, wherein the one or more strength enhancing features further comprises a plurality of slots positioned about the pair of first panels and/or the pair of adjoining second panels.

14. The reinforced corrugated carton of claim 12, wherein the reinforced corrugated carton comprises a regular slotted carton.

15. A reinforced corrugated carton, comprising:

a plurality of panels comprising a pair of first panels and a pair of adjoining second panels;

wherein the pair of second panels have a lesser length than the pair of first panels;

the plurality of panels forming an enclosure comprising the pair of first panels and the pair of adjoining second panels, and further comprising a top wall, and a bottom wall, wherein the pair of first panels and the pair of adjoining second panels each have vertically oriented flutes; and the pair of first panels comprising a plurality of strength enhancing features;

wherein the plurality of strength enhancing features comprises a linear combination of intermittent scores and perforations absent a coexisting fold line extending vertically between a bottom and a top of each panel of and disposed at a center of each panel of the pair of first panels parallel with the vertically oriented flutes; and wherein the plurality of strength enhancing features further comprises a plurality of slots positioned about the pair of first panels and/or the pair of adjoining second panels;

wherein the each linear combination of intermittent scores and perforations subdivide each panel of the pair of first panels without each respective linear combination of intermittent scores and perforations extending beyond planar outer planar inner surfaces of each panel of the pair of first panels.

16. The reinforced corrugated carton of claim 15, wherein the reinforced corrugated carton comprises a regular slotted carton.

17. A reinforced carton, comprising:

a plurality of first panels comprising a first sidewall panel and a second sidewall panel;

a plurality of second panels that adjoin the plurality of first panels, the plurality of second panels comprising a first end wall panel and a second end wall panel;

wherein the first and second end wall panels have a lesser length than the first and second sidewall panels;

the plurality of first panels and the plurality of adjoining second panels forming an enclosure comprising the first sidewall panel, the second sidewall panel, the first end wall panel, the second end wall panel, and further comprising a top wall, and a bottom wall, wherein the first sidewall panel, the second sidewall panel, the first end wall panel, and the second end wall panel each have vertically oriented flutes; and the plurality of first panels comprising one or more strength enhancing features;

wherein the one or more strength enhancing features comprise a vertical fold line extending between, and no further than, a bottom and a top of the first sidewall panel, the vertical fold line oriented parallel with the vertically oriented flutes;

wherein the vertical fold line subdivides the first sidewall panel without the vertical fold line extending beyond planar outer and planar inner surfaces of the first sidewall panel.

18. The reinforced carton of claim 17, wherein the enclosure is formed of a single piece of corrugated material.

19. The reinforced carton of claim 17, wherein the one or more strength enhancing features further comprises a second vertical fold line extending between, and no further than, a bottom and a top of the second sidewall panel, wherein the second vertical fold line subdivides the second sidewall panel without the second vertical fold line extending beyond planar outer and planar inner surfaces of the second sidewall panel.

20. The reinforced carton of claim 17, wherein the one or more strength enhancing features further comprises a plurality of slots positioned about the plurality of first panels and/or the plurality of adjoining second panels.

21. The reinforced carton of claim 17, wherein the reinforced carton comprises a regular slotted carton.

22. The reinforced carton of claim 17, wherein:

the enclosure is a rectangular enclosure;

the first and second sidewall panels are longer than the first and second end wall panels are wide; and the vertical fold line is disposed at a center of the first sidewall panel.

* * * * *